US008026677B2

(12) United States Patent
Pöhler

(10) Patent No.: US 8,026,677 B2
(45) Date of Patent: Sep. 27, 2011

(54) METHOD FOR DIMMING THE LIGHT EMITTED FROM LED LIGHTS, IN PARTICULAR IN THE PASSENGER CABIN OF AN AIRLINER

(75) Inventor: Ulrich Pöhler, Offenhausen (DE)

(73) Assignee: Diehl Aerospace GmbH, Uberlingen (DE)

( * ) Notice: Subject to any disclaimer, the term of this patent is extended or adjusted under 35 U.S.C. 154(b) by 396 days.

(21) Appl. No.: 12/139,570

(22) Filed: Jun. 16, 2008

(65) Prior Publication Data

US 2009/0026976 A1 Jan. 29, 2009

(30) Foreign Application Priority Data

Jul. 23, 2007 (DE) ..... 10 2007 034 177

(51) Int. Cl.
*H05B 39/00* (2006.01)
*H05B 37/02* (2006.01)

(52) U.S. Cl. ..... 315/312; 315/291

(58) Field of Classification Search ..... 315/209 R, 315/224, 247, 291, 307, 308, 312
See application file for complete search history.

(56) References Cited

U.S. PATENT DOCUMENTS

| | | | | |
|---|---|---|---|---|
| 7,113,541 | B1 * | 9/2006 | Lys et al. | 375/238 |
| 7,137,594 | B2 * | 11/2006 | Mitchell et al. | 244/118.6 |
| 7,148,632 | B2 | 12/2006 | Berman et al. | |
| 7,482,760 | B2 * | 1/2009 | Jungwirth et al. | 315/185 R |
| 7,543,951 | B2 * | 6/2009 | Koerner et al. | 362/99 |
| 7,737,643 | B2 * | 6/2010 | Lys | 315/291 |
| 2006/0071823 | A1 | 4/2006 | Jungwirth | |
| 2006/0245174 | A1 | 11/2006 | Ashdown et al. | |
| 2008/0191642 | A1 | 8/2008 | Slot et al. | |

FOREIGN PATENT DOCUMENTS

| | | | |
|---|---|---|---|
| DE | 10 2005 016 729 | B3 | 10/2006 |
| DE | 10 2005 049 579 | A1 | 4/2007 |
| DE | 10 2005 054 541 | A1 | 5/2007 |
| GB | 2 408 315 | A | 5/2006 |
| WO | WO2006015476 | A1 | 2/2006 |
| WO | WO2006054230 | A1 | 5/2006 |

* cited by examiner

*Primary Examiner* — Douglas W Owens
*Assistant Examiner* — Minh D A
(74) *Attorney, Agent, or Firm* — Scully, Scott, Murphy & Presser, P.C.

(57) ABSTRACT

In order to dim the brightness of the mixed-color light from an LED light (11) with LED arrays (12*r*, 12*g*, 12*b*) which emit different colors, in particular in the passenger cabin of an airliner, the current-flow time intervals (tr, tg, tb) which can be adjusted such that they are different over the various arrays (12) are shortened in steps during initially constant working period lengths (ta).

9 Claims, 3 Drawing Sheets

METHOD FOR DIMMING THE LIGHT EMITTED FROM LED LIGHTS, IN PARTICULAR IN THE PASSENGER CABIN OF AN AIRLINER

BACKGROUND OF THE INVENTION

1. Field of the Invention

The invention relates to a method for the dimming of the light emitted from LED lights, and in particular, in the passenger cabin of an airliner.

2. Discussion of the Prior Art

DE 10 2005 016 729 B3 discloses the dimming of the light emitted from a white-light light-emitting diode (LED) in successive working periods without any gaps and of the same length as one another, in each of which high-frequency chopping takes place of the current which flows during the switched-on time intervals in the successive working periods through the diode. The shorter the switched-on time interval in the working period is, the fewer constant-current pulses flow through the LED and in consequence the lower is the brightness of the emitted light.

In order to vary the color impression of an LED light, the light emitted from LED arrays in the primary colors red, green and blue is normally superimposed with different intensity, for which purpose the individual arrays have their array-current time intervals controlled independently of one another in the working periods, for dimming purposes.

However, only a dimming ratio in the order of magnitude of 1:1000 between dark and bright can be achieved in this way. This is no longer sufficient for, for example, constant-color variable dimming impressions (for example the extended transition over time from starlit heavens to sunrise in the case of the lighting in a passenger cabin) with gamut color correction (compensation for the shift to a warmer light color during the transition to reduce brightness), when the RGB light-emitting diode arrays are already being operated in a highly dimmed form, that is to say at a very low brightness which can be adjusted in this way; the aim is to achieve a dimming ratio that is greater than this by at least one order of magnitude to allow operation at even lower levels, before being completely switched off.

This is because in gamut color correction, which is required for high-quality, constant-color lighting effects, is dependent on very short current-flow times through light-emitting diodes. This is because it is then possible to compensate for variation of the color loci of LEDs within a production batch. Specifically, in order nevertheless to achieve a specific primary color, with two other primary colors are mixed in with low intensities even during the production matching process or later during operation (controlled by photodiodes), as a result for the respective color locus written from the color triangle, as written in the CIE standard color table (into what is also referred to as the color shoe) for the LEDs. For example, a gamut-corrected guaranteed color locus of "blue, unsaturated" is produced by driving the green LED at 5% and the red LED at 2%, in addition to the blue LED being driven at full power (100%). In order to present this color locus with a low brightness, for example dimmed to 1%, with a drive cycle of 3 ms, this results in the blue being switched on for a time of 1% of the full cycle, that is to say 30 μs, the green being switched on for 1% of 5%, that is to say 0.05% (1.5 μs), and the red being switched on for 1% of 2%, that is to say 0.02% (0.6 μs current flow through the red LED).

Passing current pulses that are as short as this through LEDs results in numerous problems. For example, these short pulses have fundamental frequencies of several hundred kilohertz, and this can lead to disturbing interference (electromagnetic interference) and frequencies which are allocated to specific radio services (for example the emergency radio at 200 kHz); excessively short-switched-off times make it difficult to discharge the natural capacitances within the LEDs; and it is not possible to produce current sinks which switch sufficiently quickly using low-cost components. Such extreme LED dimming would be feasible from the circuitry point of view only by using very fast and therefore expensive processes with a high coding depth for the fine subdivision of the working period, together with high-power, radio-frequency transistors for the current sinks in the R, G and B diode series circuit, that is to say with a rarely acceptable level of circuitry complexity.

SUMMARY OF THE INVENTION

Accordingly, in order to obviate the foregoing limitations, the present invention is based on solving the technical problem of developing a method of this generic type such that, even with restricted processor capacity and, in conjunction with current sinks using bipolar circuit technology, which is available at low cost since it is conventional, extremely low, that is to say low-light dimming settings can be predetermined reproducibly for LEDs, and can then also be varied finely.

This object is achieved by the substantial features specified in the main claim. This results in a drive cycle for the LEDs which are subject, so to speak, to superimposed low-frequency modulation. In particular as the cycle is lengthened, the current integral over the cycle is reduced, despite the current-flow time interval not being shortened any further, that is to say without having to reduce the duty ratio of the working period further for the further reduction in the emission from the LEDs that then occurs.

This solution is implemented particularly advantageously by the cycle being subdivided into a working period with current flow for a limited time and at least one subsequent period, referred to here as the no-load period, when no current flows.

The no-load period during which no current flows in the (overall) cycle, that is to say between two successive working periods separated from one another by a no-load period, makes it possible to vary the dimming on an even more finely graduated basis, for example by a succession of a different number of no-load periods of the same length, and/or by varying the lengths of the no-load periods.

In order to avoid a color shift or a sudden change in brightness when the number or the length of the no-load periods in one cycle is varied, this switching is expediently carried out at the end of a cycle comprising a working period and no-load periods, the pulse duration in the LED arrays can be set to a temporarily constant cycle current integral in order to prevent any certain change in the current integral occurring at this moment, that is to say avoid a brightness fluctuation and an abrupt current change.

Finally, the length of the working periods in which the current pulses of constant length occur can also be varied in the successive cycles in order to influence the current integral over the cycle, which governs the brightness of the emitted radiation, without having to shorten the current-flow time intervals even further for further dimming.

The critical factor according to the invention is therefore that the shortest current-flow time interval which can still be managed without problems using bipolar technology for the current sinks and with a processor with an accepting coding depth need not be shortened any further for further dimming, but can then remain constant because the cycle is now lengthened in the form of superimposed frequency modulation. The resultant current flow is now varied by variation of the cycle lengths for the diode arrays, in particular by being reduced even further, without changing the current-flow time interval itself and in particular without having to reduce it further. In consequence, there is no need to increase the coding depth on the processor used to drive the current sinks in the array in the sense of finer graduation of the current-flow time intervals and this therefore also leads to the current sinks not themselves being driven with radio frequency, as a result of which the hardware technology that has been introduced can still be used despite the considerably increased dimming ratio.

Visually, this noticeably improves the light resolution and color locus gamut (the described compensation for color locus displacement in an LED by minimal current-flow changes in the two other LEDs). The dimming ratio which is required for this purpose and is achieved according to the invention is considerably greater than 1:10,000, which would not be achievable using analogue circuit technology, therefore allowing a wide brightness dynamic range while ensuring a high level of color locus realism down to very low light emission brightness levels, to which the human eye, which is adapted to instantaneously relatively brightest color, reacts in a manner which is particularly sensitive to color.

BRIEF DESCRIPTION OF THE DRAWINGS

Additional alternatives and developments of the solution according to the invention, also with respect to their advantages, are derived from the following description of one preferred exemplary embodiment relating to the implementation of the method according to the invention, wherein in the drawings.

DETAILED DESCRIPTION OF THE INVENTION

Figure 1:
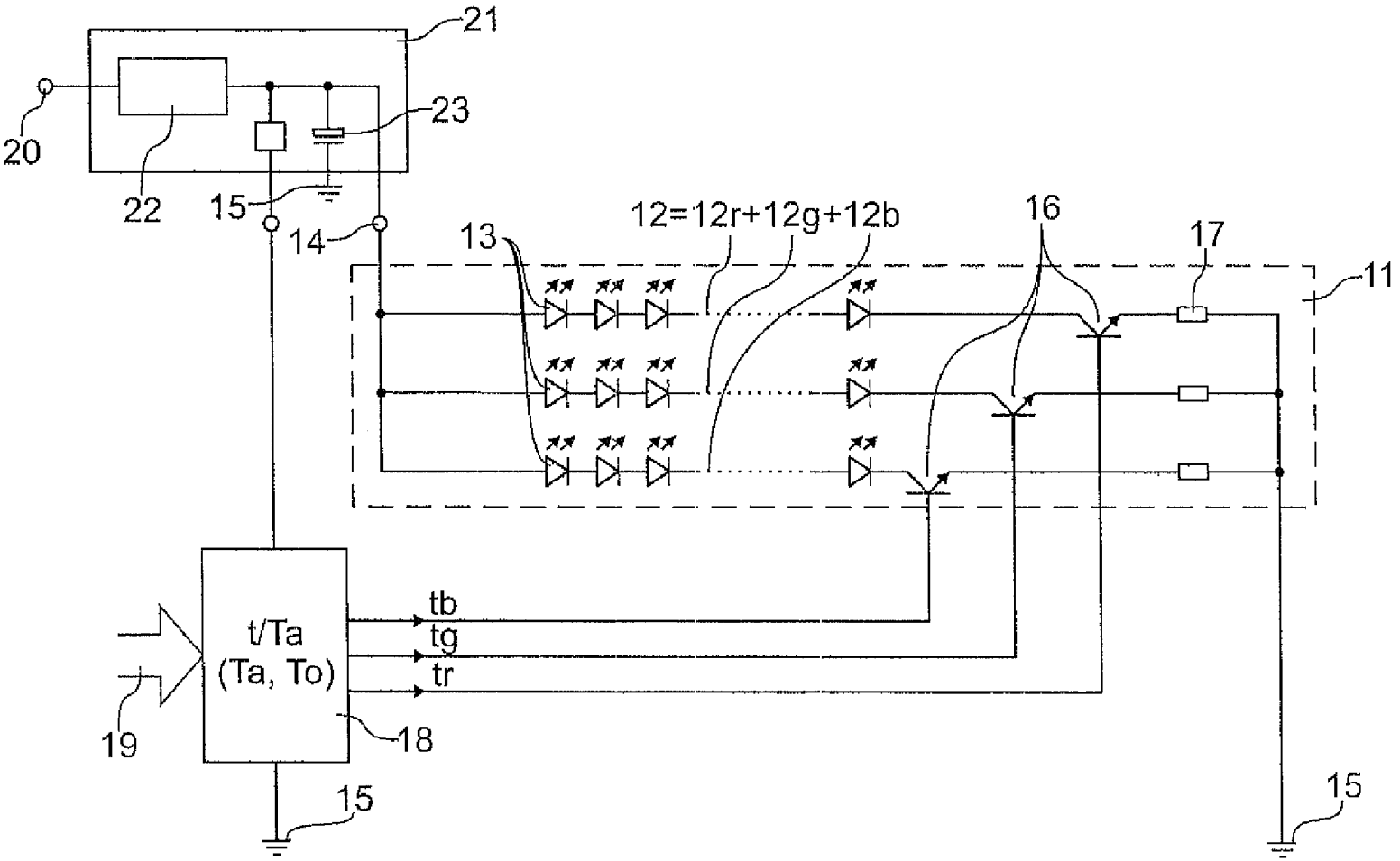
FIG. 1 shows a simplified circuit diagram for individual color driving for a light with LED arrays with the three primary colors red, green and blue.

The light 11 represented symbolically in FIG. 1 has in each case one array 12 (12*r*, 12*g* and 12*b*) whose brightness can be controlled individually formed by series circuits, of red, green and blue light-emitting diodes 13; this sketch ignores the fact that a white-light array, whose brightness is likewise controllable, and composed of LEDs which intrinsically emit blue but are coated with phosphorus is also expedient for fine color correction and in order to influence the color saturation. Each array 12 is connected between a supply voltage 14 (typically of 55 volts) and the appliance earth 15, in the direction of the latter via a constant-current sink 16 in the form of a bipole transistor, connected in the common-emitter form, with its emitter resistance 17.

A commercially available microprocessor 18 with a coding depth of typically 2 exp 4=16 bits time resolution within one working period Ta in each case switches on the transistors in the constant-current sinks 16 independently of one another over a time interval tr, tg, tb. The length of these individual current-flow time intervals t in each case determines, via the cyclic current-time integral, the resultant array current level and therefore the intensity (brightness) of the associated red, green and blue mutually superimposed emitted colors. This actual color mixing from the three arrays 12 results in the light color emitted from the light 11. The currently desired color mixture and its intensity are determined by a higher-level, external control signal 19 for the individual current-flow time intervals t.

In a temperature-dependent or current-dependent color locus drift can be expected (as in particular in the case of light-emitting diodes 13*r*, 13*g* which emit red and green), a matched gamut color locus correction is preset in the programming of the processor 18 or in the external signal 19 by minimal variation of time intervals t.

In order to reduce the current integral in the respective array 12, the current-flow time interval t can be reduced in steps within a working period Ta, which typically has a length of 3 milliseconds, corresponding to a repetition frequency of 333 Hertz. For high resolution, that is to say for small step widths, the working period Ta must be appropriately finely subdivided, that is to say the processor 18 must have a correspondingly high coding depth preset even very short time intervals t, which makes it much more expensive. A narrow-pulse drive for the current sinks 16 such as this would also be at too high a frequency for operation of constant-current transistors using low-cost bipolar technology.

Figure 2:
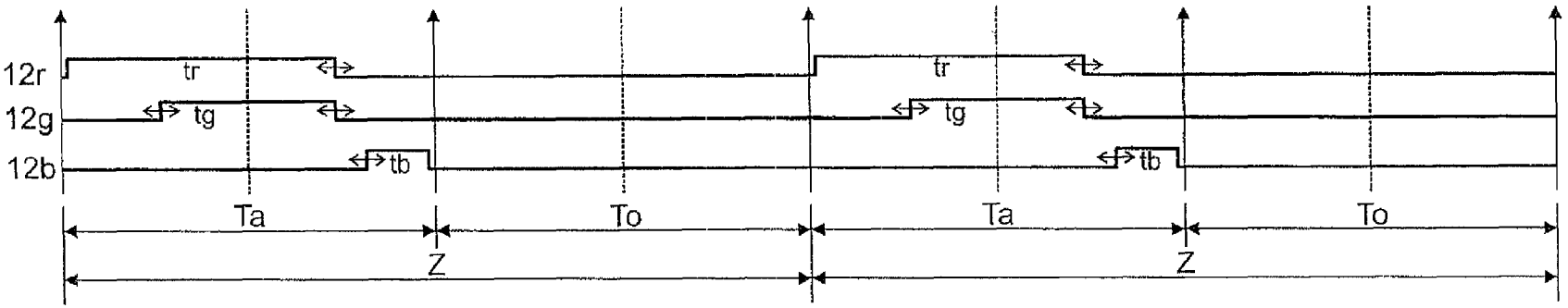
FIG. 2 shows timing diagrams for the drive for the arrays shown in FIG. 1 with cycles comprising alternating sequences of working periods and no-load periods of mutually identical lengths for greatly dimmed light operation.

Switching therefore takes place to frequency modulation (for example as shown in FIG. 2) of all the instantaneously selected current integrals in a working period Ta at the latest when the current flow t in at least one of the arrays is not intended to be shortened any further—in particular because of the lack of finer resolution as a function of the processor. The actual array current integrals at that time—although these can still be varied individually within the scope of the given processor coding depth—are now reduced further for additional dimming, specifically for even greater dimming, by a working period Ta being followed by (at least) one no-load period To during which no current flows, that is to say first of all the current sinks 16 are not driven again, but with a working period Ta with a current-flow time interval t starting again once a drive cycle, which is now Z=Ta+To, since the time current-flow integral fills overall over the lengthened cycle Z even if the current-flow time duration t is not changed throughout the working period Ta, the emitted brightness is reduced without having to increase the coding depth in the processor 18, for example, to do so. In comparison to the greatest previously achievable dimming of about 0.1%, this means that the resolution of the current flow through the array 12 is increased by a factor of at least 10, therefore also providing improved capabilities to influence the light locus even at extremely low dimming levels.

Figure 3:
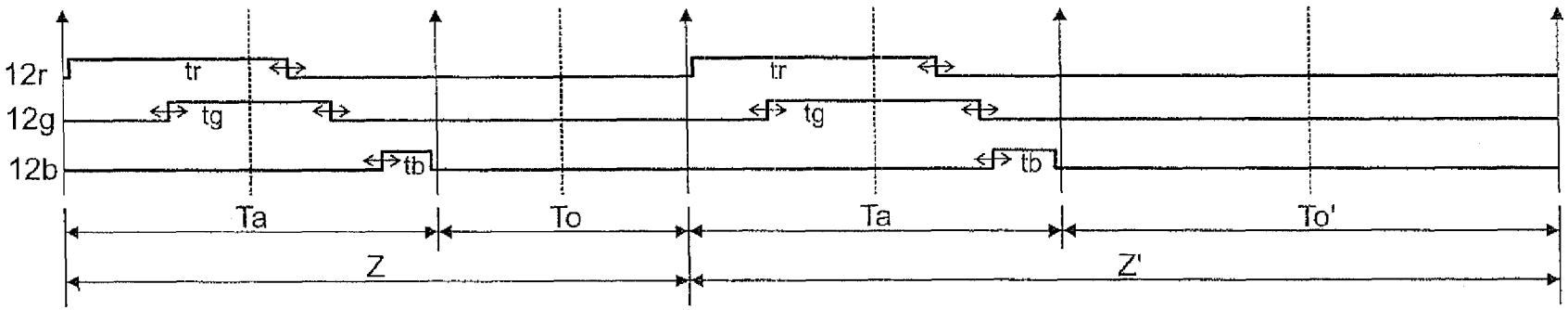
FIG. 3 shows a variation of the drive shown in FIG. 2 by varying lengths of no-load periods, in particular for color-correctable smooth brightness transition between entirely switched off light operation, and light operation switched on only to a minimal extent.

Furthermore, as is shown in FIG. 3, the no-load periods To can be varied (shortened and lengthened) in order to further vary the cycle lengths Z' and thus the resultant current integral without influencing the time intervals t. With a constant coding depth, this results in even further graduation of the current flow integral and therefore in an increase in the light color impression, particularly at very low brightness levels.

Figure 4:
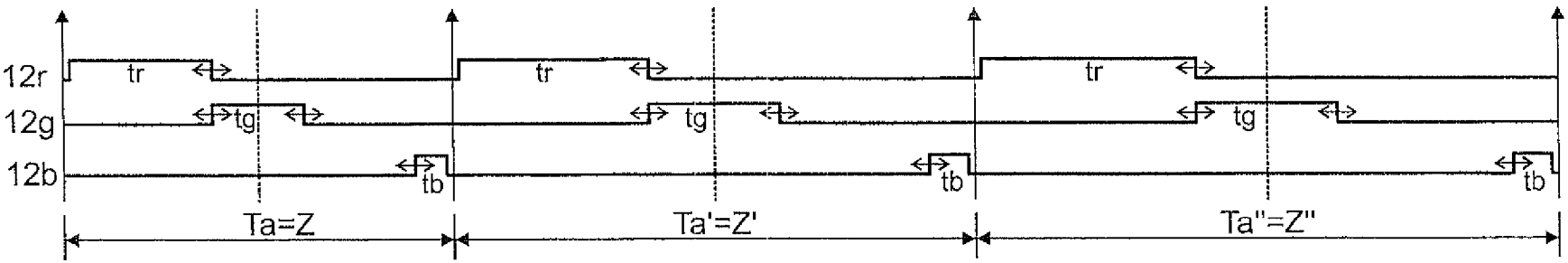
FIG. 4 in contrast with FIG. 2 and FIG. 3, shows variable lengths of the working periods in order to vary the current integral, in his case without the introduction of no-load periods.

When the no-load periods To have shrunk to zero, the current integrals can still be varied even without changing the time intervals t by influencing the lengths of the working periods Ta from the processor 18, which working periods Ta now follow one another directly and therefore in their own right make up the cycle lengths Z, and are at a very low frequency in comparison to the time intervals t, as is sketched in FIG. 4. Owing to the increasingly finer resultant current graduation, a smooth change in the drive as shown in FIG. 3 to that shown in FIG. 4 allows, so to speak, a dynamic transition from low brightness to very low brightness with the color locus shifts which occur during this process otherwise being compensated for in the emissions from the individual arrays 12 until, finally, a state is reached in which the light emission is switched off completely—without any need in the process to overload the functional limits in the processor 18, since frequency-critically short current-flow time intervals t would be necessary.

Bright emission from the light 11, on the other hand, that is to say less intense dimming, is not critical to operation of the processor 18 because the current-flow time intervals t are then lengthened. There is then no need whatsoever to vary the cycle lengths Z in order to influence the current integral through the arrays 12, and switching takes place to conventional operation with variable time intervals t in the immediate sequence of a fixed period pattern Ta (that is to say also without any intermediate no-load periods To). Such switching from variable to fixed cycles Z=Ta also expediently takes place at the end of a cycle Z, in order at the same time to avoid a color change which would otherwise have to be regulated out again immediately over the individual time intervals t.

The timing diagrams in FIG. 2 to FIG. 4 take account of the fact that the variable current-flow time intervals tr, tg and tb which occur within the working periods Ta, T'a should as far as possible be offset with respect to one another, specifically from the start of the period, around the period centre and before the period end.

Such interleaving avoids visually disturbing stroboscopic effects, such as those which can occur when colors are driven sequentially in such a way that only one of the primary colors is ever illuminated at any one time; or generally, when a light is produced at a very low frequency (considerably less than 100 Hz).

A high-frequency (typically at 400 Hz) AC voltage aircraft power supply system 20 feeds a power supply unit 21 with a voltage converter 22 in order to produce the supply voltage 14. Load changes are coped with by a high capacitance buffer 23 (and voltage regulation, which is not shown in the drawing). In particular, the energy stored in the buffer 23 is available when an LED has actually been switched on during the voltage zero crossing on the aircraft power supply system 20. The buffer 23 is then recharged until the next zero crossing of the aircraft power supply system 20. In order to avoid humming phenomena, which are dependent on the efficiency, in this case, the buffer 23, typically an electrolytic capacitor, must be of quite a large size, thus representing a considerable cost factor. The switch-on interleaving of the diodes, however, reduces the load on the power supply unit 21, thus making it possible to use a low-cost, smaller buffer 23.

If a working period Ta has an average length of 3 ms (corresponding to 333 Hz), this results in a beat frequency of 67 Hz with the aircraft power supply system frequency of 400 Hz, which can be regulated out well without additional circuitry complexity. In particular, this repetition rate is sufficiently high to avoid light flickering resulting from beat phenomena resulting from light sources being driven in mutually adjacent frequency bands.

In order to dim the brightness of the mixed-color light, and an LED light 11 with LED arrays 12*r*, 12*g*, 12*b* which emit different colors, in particular in the passenger cabin of an airliner, the current-flow time intervals tr, tg, tb, which can be set differently over the various arrays 12, are therefore shortened in steps during initial conventionally constant working-period lengths Ta—starting from the rated current (typically of about 25 mA) for maximum brightness—until one of the arrays 12 is typically being driven (a dimming level) at only 1% of the normal brightness. In this case, frequency components occur in the array drive which can lead to beat phenomenon with light at the frequency of the aircraft power supply system 20, or, if the coding depth of the current-control processor 18 or the response of the constant current sinks 16 behind the LED arrays 12 no longer allow further dimming by further shortening of the current-flow durations t in each case one of the arrays 12, further even more finely graduated dipping can be achieved according to the invention by lengthening the cycles Z, by lengthening the working periods Ta and/or by an insertion of constant or variable lengths of no-load periods To, during which no current flows, between successive working periods Ta, specifically for further reduction of the current intervals in the arrays 12 over the instantaneous cycle Z even without further shortening of an already critically short current-flow time interval t itself, if necessary with the current-flow time intervals t being matched to the desired emission intensity and color of the other arrays 12. With the circuitry technology that has been introduced for the constant-current sinks 16 in the LED arrays 12 and without increasing the coding depth in the processor 18 for the stepped current-flow time control t, this allows fine color correction for a mixed-color impression which remains constant even at extremely low brightness levels, as far as a smooth transition to the light OFF situation; conversely, this also allows constant-color mixed-color light to be produced from the LED light 11 despite very slow dimming. In this case, this effective current variation which is achieved with extremely fine steps overall using conventional hardware allows gamut color correction (that is to say compensation for the color locus shift which occurs towards long wavelengths when current is reduced, in the normal color table, by slightly influencing the brightnesses of the primary colors that are mixed in) even at a very low brightness level, and compensation for ageing-dependent brightness losses, which differ as a function of the color, in the various LED arrays 12.

LIST OF REFERENCE SYMBOLS

11 Light (with 12)
12 Array (of 13)
13 Light-emitting diode (LEDs)
14 Supply voltage (for 12)
15 Appliance earth (of 11)
16 Constant current sink (in series with 12)
17 Emitter resistance (of 16)
18 Processor
19 Control signal (to 18 for t and possibly for T)
20 Aircraft power supply system
21 Power supply unit (on 20)
22 Voltage converter (in 21)
23 Buffer (in 21 between 22 and 11)
t time intervals (tr, tg, tb for 12*r*, 12*g*, 12*b* during Ta)
T, T' Periods (Ta=working period; To=no-load period)
Z, Z' Cycles (Ta and, respectively, Ta+To)

What is claimed is:

1. A method for dimming a light emitted from LED lights, by variation of LED current-flow time intervals during cyclically successive working periods, providing a drive cycle for current-flow time intervals which are determinable independently of one another over multicolor LED arrays, wherein said LED lights is in a passenger cabin of an airliner, wherein the drive cycle is subjected to a variation in a cycle length thereof and wherein the cycle length is varied when current flows through at least one of the LED arrays over a time interval which is short in comparison with a present working period length and wherein a sequence of the drive cycles is in each case composed of a sequence of a working period during which current flows and at least one or more no-load periods during which no current flows.

2. A method according to claim 1, wherein the variation in the cycle length starts when a current-flow time interval which is as short as possible, from a hardware standpoint, occurs in at least one of the LED arrays.

3. A method according to claim 1, wherein there are varied lengths of the working periods in which there occur the current-flow time intervals.

4. A method according to claim 1, wherein a switching between different cycle lengths, in each instance, takes place at a cycle end.

5. A method for dimming a light emitted from LED lights by variation of LED current-flow time intervals during cyclically successive working periods, providing a drive cycle for current flow time intervals which are determinable independently of one another over multicolor LED arrays, wherein said LED lights is in a passenger cabin of an airliner, wherein the drive cycle is subjected to a variation in a cycle length thereof and wherein a sequence of the drive cycles is in each case composed of a sequence of a working period during which current flows and at least one or more no-load periods during which no current flows.

6. A method according claim 5, wherein the lengths of the at least one or more no-load periods are varied.

7. A method according to claim 5, wherein the time interval of the respective current flow in the LED arrays with respect to a start of a working period starts with a time offset between them.

8. A method according to claim 7, wherein the current flow in one of the LED arrays commences at the start of each working period, but before an end of the respective working period in an LED array of a different color.

9. A method according to claim 7, wherein the current-flow time interval in a further one of the LED arrays is in each case symmetrical in time with respect to a centre of the working period.

* * * * *